US006342847B1

(12) United States Patent
Archuleta et al.

(10) Patent No.: US 6,342,847 B1
(45) Date of Patent: Jan. 29, 2002

(54) VIRTUAL FENCE SYSTEM AND METHOD

(75) Inventors: Anthony Thomas Archuleta, Colorado Springs; Kim Donald Langdon, Falcon; Paul Joseph McDermott, Colorado Springs, all of CO (US)

(73) Assignee: National Systems & Research Co., Colorado Springs, CO (US)

( * ) Notice: Subject to any disclaimer, the term of this patent is extended or adjusted under 35 U.S.C. 154(b) by 0 days.

(21) Appl. No.: 09/675,444

(22) Filed: Sep. 28, 2000

(51) Int. Cl.[7] ..... G08G 1/123

(52) U.S. Cl. ..... 340/988; 340/989; 340/996; 340/573.4

(58) Field of Search ..... 340/568.1, 568.5, 340/571, 572.4, 573.1, 573.3, 573.4, 541, 686.1, 988, 989, 992, 995, 996; 342/357.06, 357.07, 456; 348/155, 170

(56) References Cited

U.S. PATENT DOCUMENTS 5,243,418 A * 9/1993 Kuno et al. ..... 348/155
5,550,551 A 8/1996 Alesio ..... 342/457
5,797,107 A * 8/1998 Berg et al. ..... 701/29
5,963,130 A * 10/1999 Schlager et al. ..... 340/573.1
6,049,281 A * 4/2000 Osterweil ..... 340/573.4
6,067,044 A 5/2000 Whelan et al. ..... 342/357.07

OTHER PUBLICATIONS

Tickets.com http://www.shareholder.com/tixx/news/20000224–14346.htm.

* cited by examiner

*Primary Examiner*—Van T Trieu
(74) *Attorney, Agent, or Firm*—Dale B. Halling

(57) ABSTRACT

A remote tracking and sensing device (20) includes a global positioning system receiver (22). A processor (24) receives a position signal from the global positioning system receiver (22). A communication interface (30) connects the processor (24) to at least two wireless communication systems (26, 28). A power management system (32) provides power to the processor (24) based on an output (38) from a motion sensor (40).

28 Claims, 7 Drawing Sheets

VIRTUAL FENCE SYSTEM AND METHOD

FIELD OF THE INVENTION

The present invention relates generally to the field of positioning systems and more particularly to a moving fence system and method.

BACKGROUND OF THE INVENTION

The ability to quickly locate high value assets for maintenance or routine servicing would greatly increase the efficiency of companies involved in using or maintaining the high value assets. The global positioning system and other satellite positioning systems have provided the promise of locating the high value assets. Unfortunately, a number of practical problems have limited the ability to track high value assets. For instance, one problem has been communicating the position information to a user. Construction equipment must communicate two or more times per day even when it has not moved from the site. This message load is costly. Another problem is the mobility of these assets. The assets may be easily moved from one site to another making the process of locating the assets difficult. Yet another problem is the determination of the proper maintenance schedule for the assets. Some equipment requires maintenance after a predetermined numbers of hours of operation. The equipment may be difficult to locate to determine the number of hours of operation that have elapsed.

Thus there exists a need for a system that can locate high value assets, that can determine the number of hours of operation for that equipment, and can transmit the position and maintenance information reliably anywhere.

DETAILED DESCRIPTION OF THE DRAWINGS

A method of operating a moving fence system includes a global positioning system (GPS) receiver. The GPS receiver provides information on the device's position. The system records the device's reported position, and determines whether the time is within an operation or nonoperation period. When the time is within an operation period, the system determines whether the device has moved a predetermined number of moving fences since the last reported position. The device then determines whether the device has been within the current moving fence for a predetermined amount of time. The device transmits a position message when the device has both moved the predetermined number of moving fences and has been within a moving fence for a predetermined amount of time.

The benefits of such a system are that a device may be moved a finite distance without triggering a message, and that the movement will not result in an overwhelming number of position messages. Thus, the system is easier to use and interpret.

Figure 1:
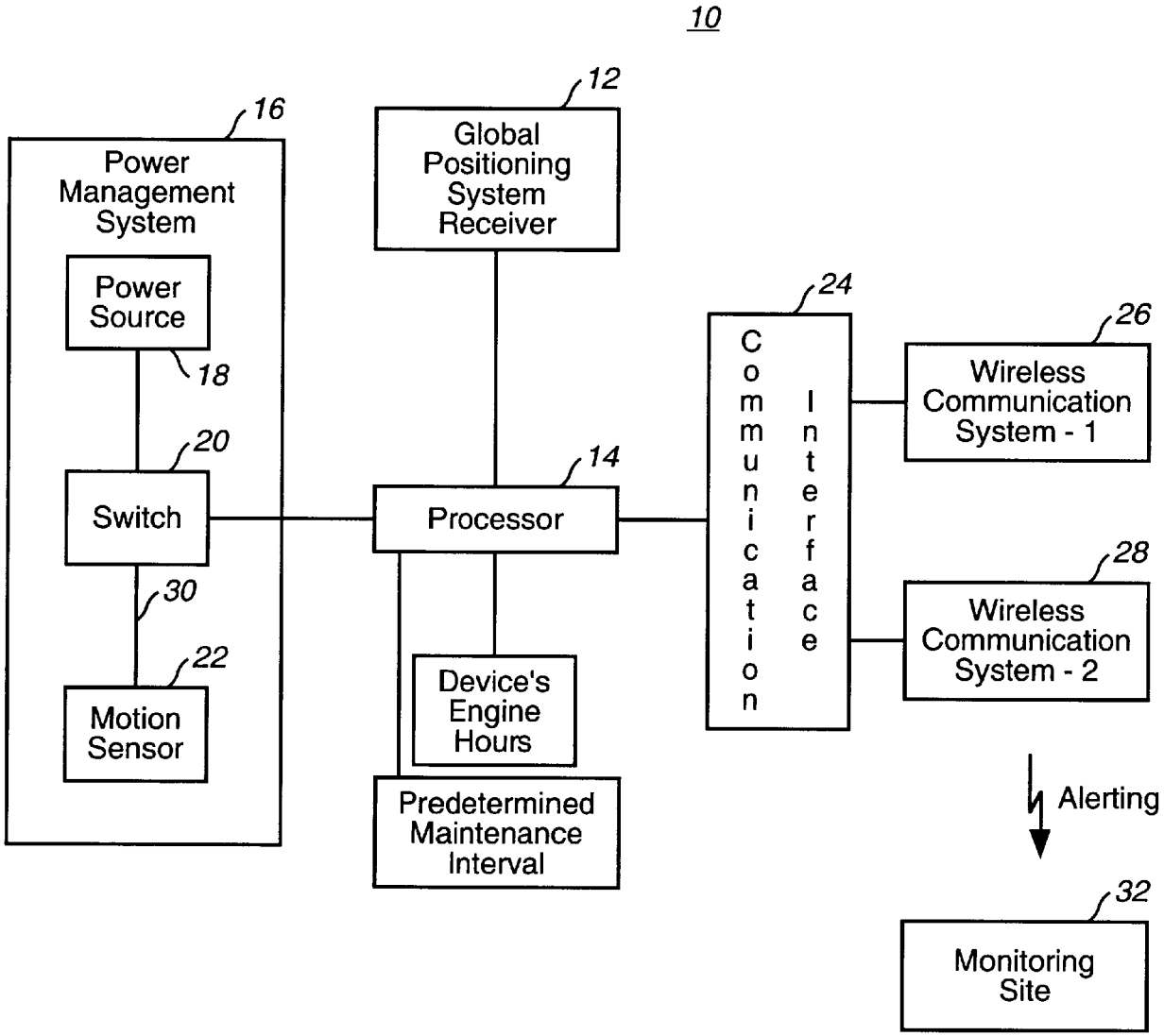
FIG. 1 is a block diagram depicting a tracking and monitoring system in accordance with one embodiment of the invention.

FIG. 1 is a block diagram of a tracking and monitoring system 10 in accordance with one embodiment of the invention. A GPS receiver 12 sends a position signal and a time signal to a processor 14. The GPS receiver 12 determines both the position and time from the GPS satellite signals. The processor 14 is connected to at least two wireless communication systems 26, 28 through a communication interface 24. The at least two communication systems 26, 28 transmit signals to a monitoring site 32. A power management system 16 provides power to the processor 14. The power management system 16 is designed to reduce the amount of power consumed by the tracking and sensing system 10. A power source 18 is connected to a switch 20. The switch 20 is controlled by an output 30 of a motion sensor 22. As a result, the processor 14 and the rest of the tracking system 10 receive power when the motion sensor 22 indicates motion. This significantly reduces the power consumption of the tracking system 10. In one embodiment the motion sensor is a vibration sensor. In another embodiment, the motion sensor is an accelerometer.

The at least two wireless communication systems 26, 28 allow the system 10 to select the second communication system 28 when the first communication system is unable to transmit a position message. This significantly increases the areas where the tracking system 10 may be used and significantly increases the usefulness of the invention. Note that more than two communication systems may be used. In one embodiment, one of the wireless communication systems 26, 28 is a satellite communication system. In another embodiment, the system 10 includes a sensor interface connected to the processor 14. The sensor interface receives a sensor information from a sensor, such as revolutions per minute from a tachometer. The processor 14 transmits the sensor information using the satellite communication system.

In another embodiment, the processor 14 includes a moving fence routine. The moving fence routine is divided into operation and nonoperation periods. An operation period is a time of normal business operation, where the emphasis is on a larger, or nonexistent, moving fence boundary and less frequent (or no) position reporting intervals. A nonoperation period is a time of inactivity, or reduced activity, such as the time period after normal working hours. Note that, in one embodiment, the actual fence will be defined in terms of latitude and longitude and therefore will not be an exact square, rectangle, or other polygon.

Figure 2:
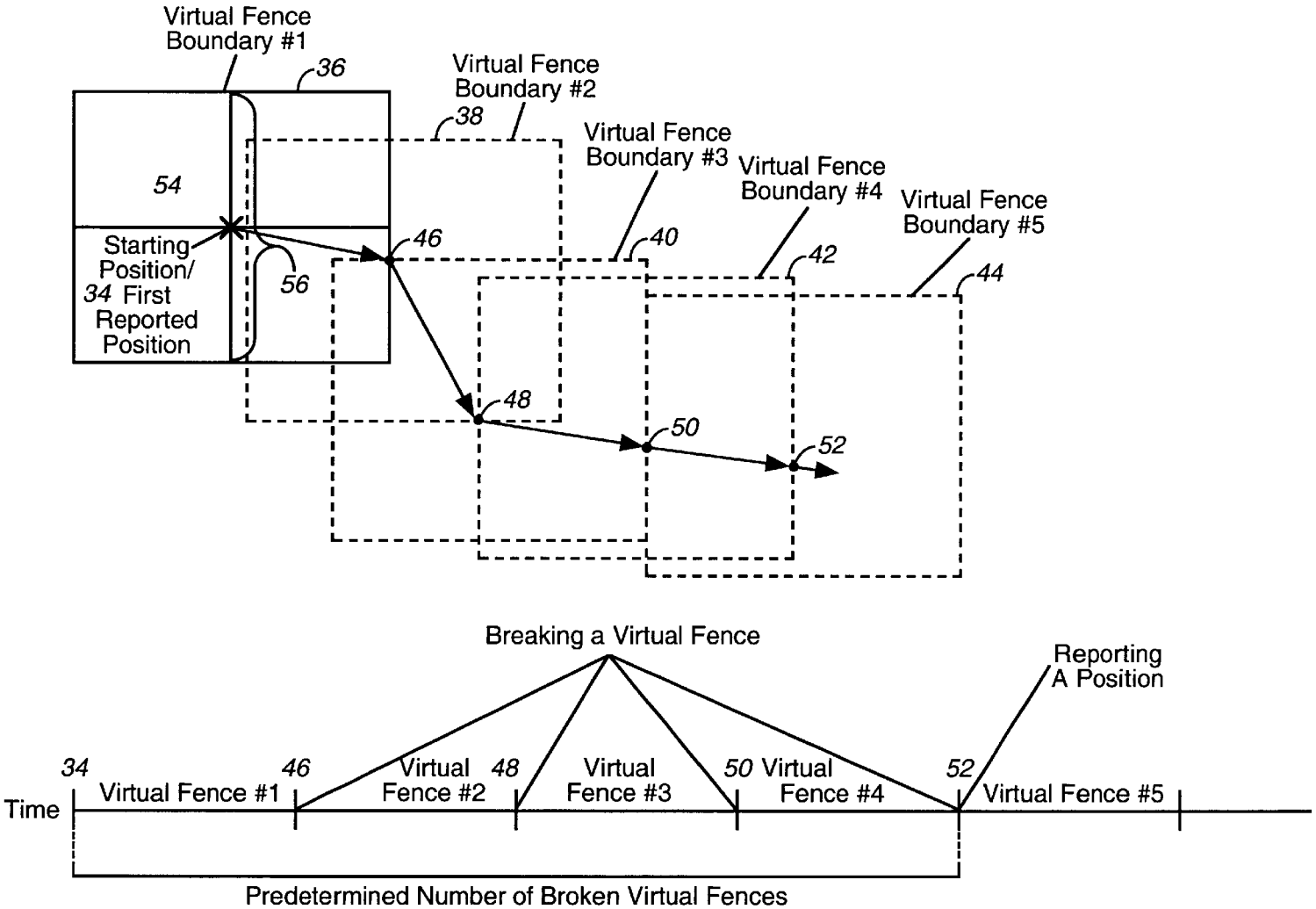
FIG. 2 is a diagram depicting the flow of events performed by a tracking monitoring system in accordance with one embodiment of the invention.

FIG. 2 is a diagram depicting the flow of events performed by a tracking and monitoring system in accordance with one embodiment of the invention. A starting position 34 is the first reported position. A first moving fence boundary 36 is created around the starting position 34 based upon a predetermined set of parameters 54, 56. As the device crosses the first moving fence boundary 36, a second moving fence boundary 38 is created. The second moving fence boundary 38 is centered on point 46, the point at which the device crosses the first moving fence boundary 36. The size and orientation of the second moving fence boundary 38 and all subsequent moving fence boundaries 40, 42, 44 is based on the same predetermined parameters 54, 56 as the first moving fence 36. The position may be reported based on predetermined parameters, for example, the number of moving fence boundaries that are crossed, when a device is within a moving fence for a minimum amount of time, when a device moves a predetermined distance, or any other helpful parameter. In FIG. 2, the device is programmed to report its position when it crosses four moving fence boundaries. In that instance position 52 is reported to the monitoring site 32.

Figure 3A:
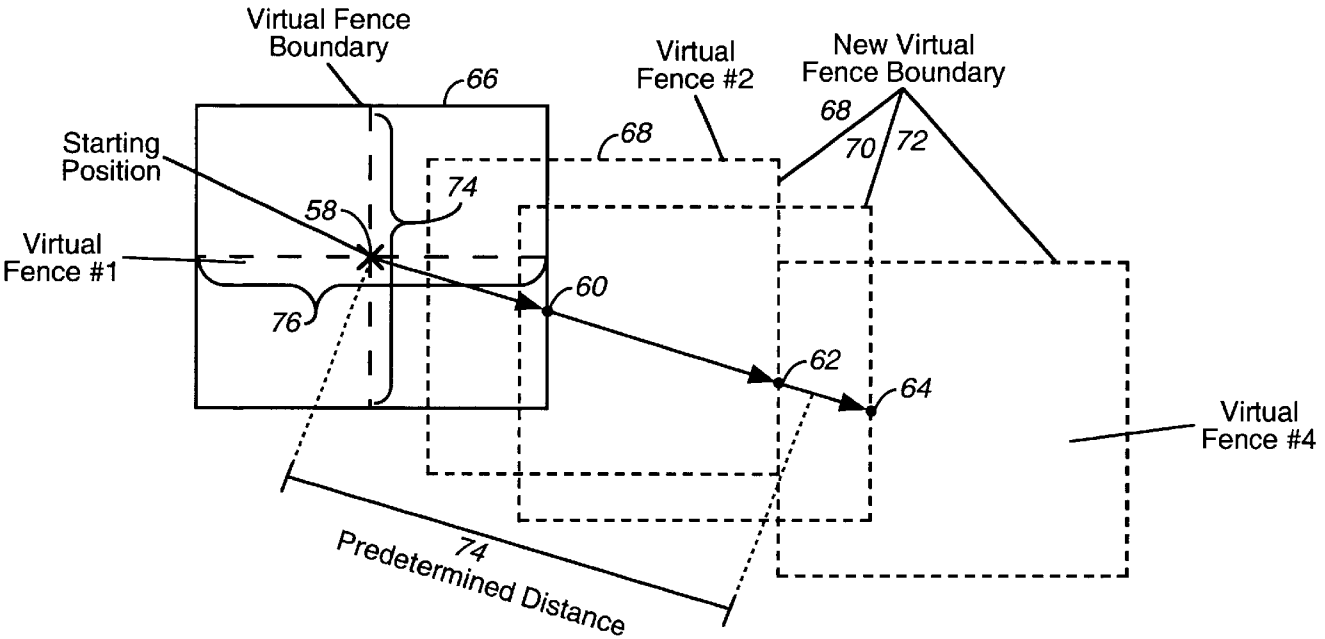
FIG. 3A is a diagram depicting the flow of events performed by the tracking and monitoring system in accordance with one embodiment of the invention.

FIG. 3A is a diagram depicting the flow of events performed by the tracking and monitoring system in accordance with one embodiment of the invention. A starting position 58 is the first reported position. A first moving fence boundary 66 is created around the starting position 58 based upon a predetermined set of parameters 74, 76. As the device crosses the first moving fence boundary 66, a second moving fence boundary 68 is created. The second moving fence boundary 68 is centered on point 60, the point at which the device crosses the first moving fence boundary 66. The size and orientation of the second moving fence boundary 68 and all subsequent moving fence boundaries 70, 72 is based on the same predetermined parameters 74, 76 as the first moving fence 66. The position may be reported based on predetermined parameters, for example, the number of moving fence boundaries that are crossed, or when a device is within a moving fence for a minimum amount of time, or any other helpful parameter. In FIG. 3A, the device is programmed to report its position when it moves a predetermined distance 74. In this example, the device would report its position between points 62 and 64.

Figure 3B:
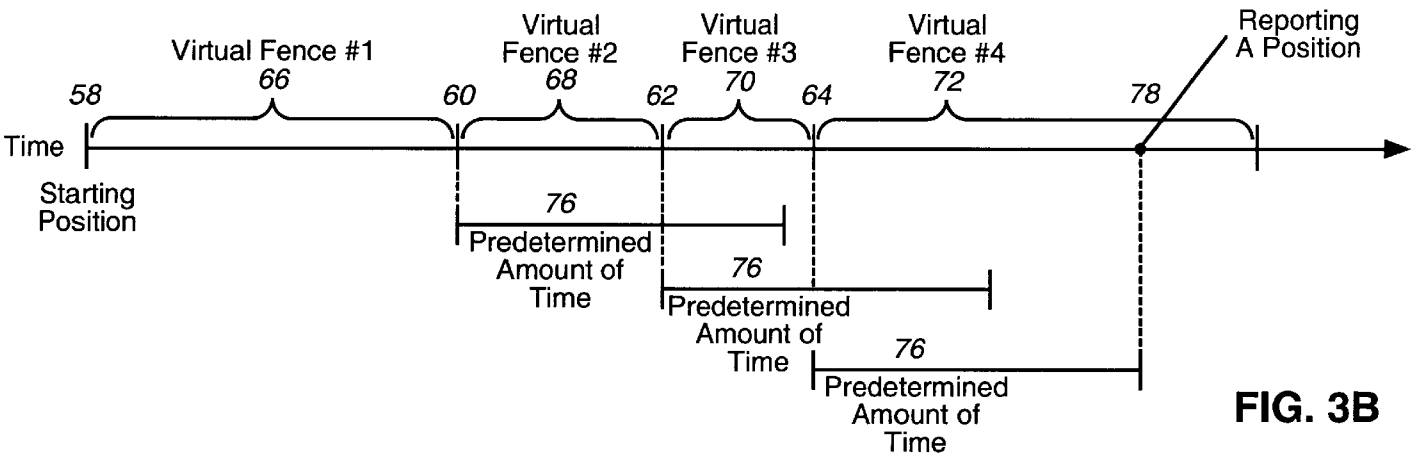
FIG. 3B is a diagram depicting the flow of events performed by the tracking and monitoring system in accordance with one embodiment of the invention.

FIG. 3B is a timeline, representing the same points and route as FIG. 3A, but the reporting position is based upon a predetermined amount of time 76 within a moving fence. The device is not within a single moving fence boundary for the predetermined amount of time until the fourth moving fence 72. At time 78 the device has been within the fourth moving fence boundary 72 for the predetermined amount of time 76. Thus, the position is reported at time 78.

Figure 4:
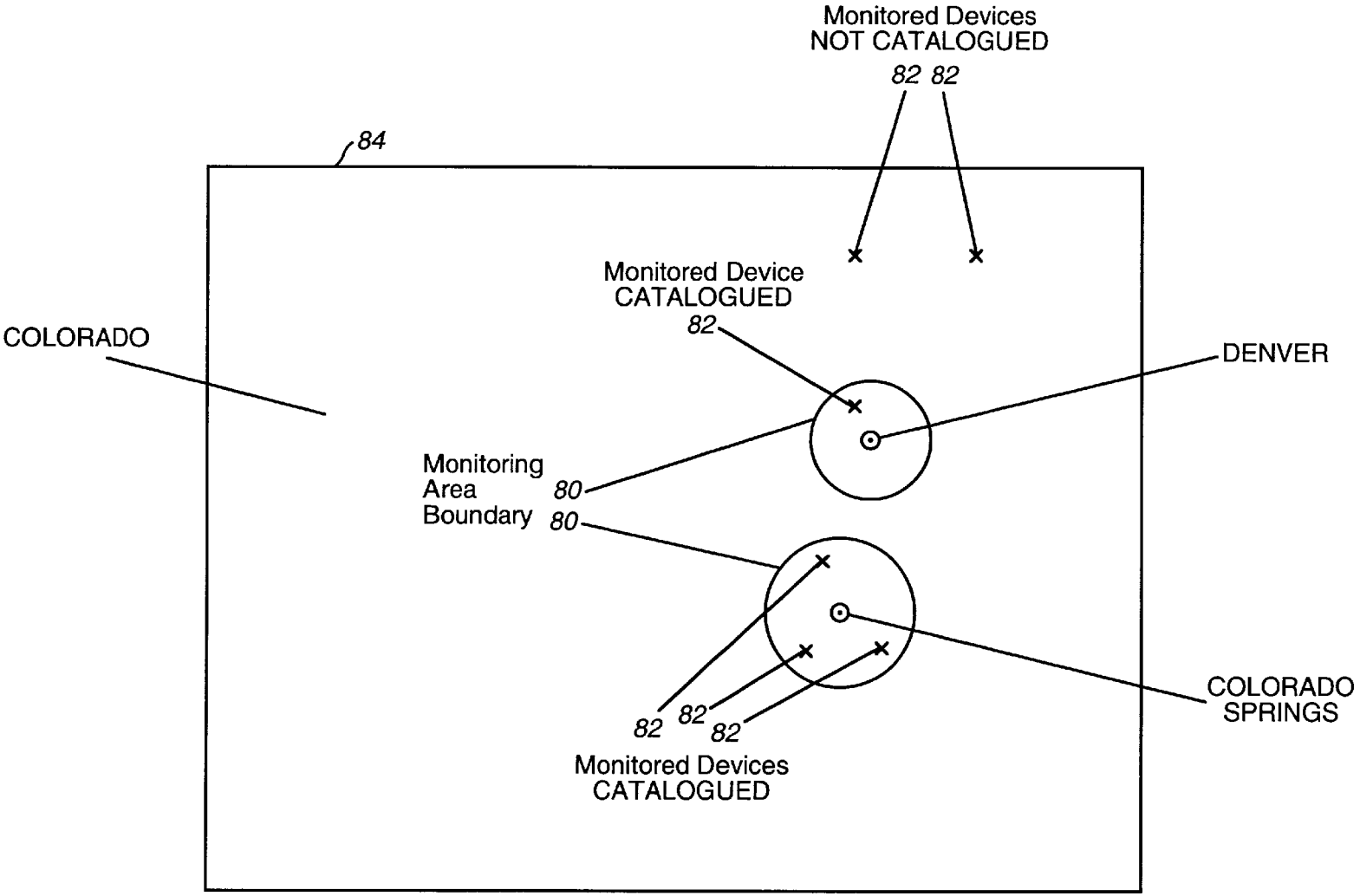
FIG. 4 is a diagram of the monitoring areas of the tracking and monitoring system in accordance with one embodiment of the invention.

FIG. 4 is a diagram of the monitoring areas of the tracking and ant monitoring system in accordance with one embodiment of the invention. Monitoring areas 80 are selected to give the desired information. Here, the monitoring areas 80 are centered on the cities of Denver and Colorado Springs, in Colorado. The monitoring areas 80 may be centered on any desired area, for example, a construction job site. As monitored devices 82 report their positions, those positions are mapped on a display 84. As a monitored device 82 enters the monitoring area 80, the monitored device 82 is catalogued. When the monitored device 82 is catalogued, the device's hours of operation are compared to a maintenance standard. Other useful parameters and operating conditions are recorded as well. This system allows the user to monitor the traffic into and out of a selected area to oversee delivery schedules, equipment allocation, and the like. The system also gives the operator accurate data for bidding similar jobs.

Figure 5:
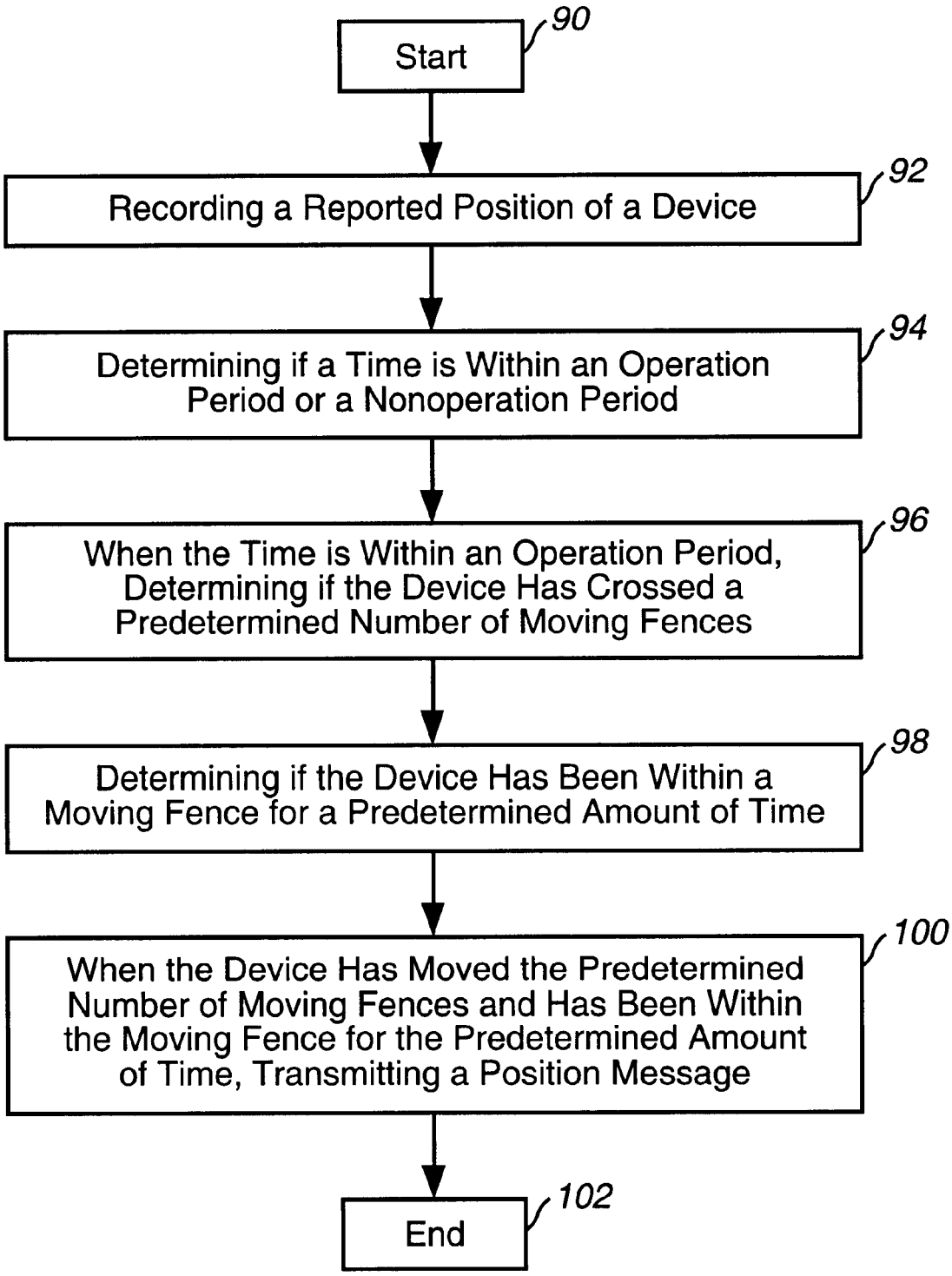
FIG. 5 is a flow chart of the steps used in a method of operating a moving fence system in accordance with one embodiment of the invention.

FIG. 5 is a flow chart of the steps used in a method of operating a moving fence system in accordance with one embodiment of the invention. The process starts, step 90, by recording a reported position of a device at step 92. The device determines if a time is within an operation or nonoperation period at step 94. When the time is within an operation period, it is determined if the device has moved a predetermined number of moving fences at step 96. Next it is determined if the device has been within a moving fence for a predetermined amount of time at step 98. When the device has moved the predetermined number of moving fences and has been within the moving fence for the predetermined amount of time, the device transmits a position message at step 100 which ends the process at step 102. In one embodiment, while in a nonoperation period, a position message is sent when the distance the device has moved exceeds a nonoperation predetermined number of moving fences and the device has been within the moving fence for the nonoperation predetermined amount of time. In another embodiment, the reported position is retained until the position message is transmitted. In another embodiment, the step of recording a reported position of a device 92 includes establishing the operation period and nonoperation period. The predetermined number of moving fences and the predetermined amount of time for both the operation period and nonoperation period is established. When the time is within the operation period, the system uses the operation predetermined number of moving fences and operation amount of time. When the time is within the nonoperation period, the system uses the nonoperation predetermined number of moving fences and nonoperation predetermined amount of time. In another embodiment, the step of determining if a device has moved a predetermined number of fences for an operation period 96 includes creating a new moving fence when the device crosses a previous moving fence. The system creates subsequent moving fences when the device crosses the new moving fence. The system determines a new position, and establishes the new moving fence boundary. In another embodiment, when the device has moved the predetermined number of moving fences, but has not been within the moving fence for the predetermined amount of time, a position message is not transmitted. In another embodiment, the position message is transmitted when the predetermined amount of time has elapsed. In another embodiment, the position message is transmitted when the device has moved the predetermined number of moving fences. In another embodiment, the position message is not transmitted when the device has been within the moving fence for the predetermined amount of time, but has not moved the predetermined number of moving fences. In another embodiment, the step of determining if a time is within an operation period or a nonoperation period 94 includes breaking a previous moving fence. In another embodiment, the system determines if the device is within a defined area when the position message is received at a monitoring site. In another embodiment, the system catalogues a plurality of devices within the defined area. In another embodiment, the position message further comprises a time, a location, and an equipment identification information.

Figure 6:
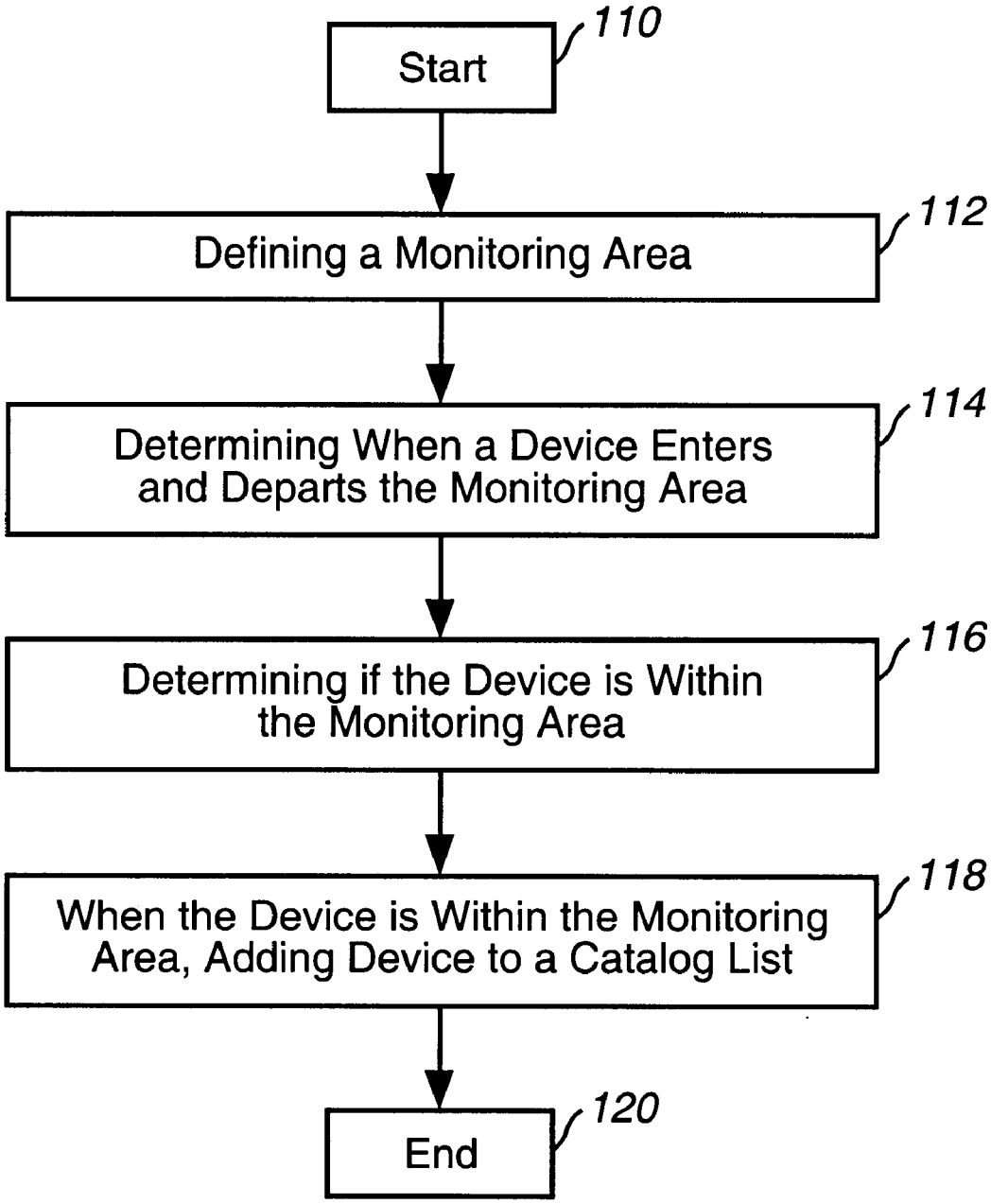
FIG. 6 is a flow chart of the steps used in a method of operating a site fence system in accordance with one embodiment of the invention.

FIG. 6 is a flow chart of the steps used in a method of operating a site fence system in accordance with one embodiment of the invention. The process starts, step 110, by defining a monitoring area at step 112. The system determines when a device enters and departs the monitoring area at step 114. If a device is within a monitoring area at step 116, then the device is added to a catalog list at step 118, which ends the process at step 120. In one embodiment, the position message includes a device's engine hours. In another embodiment, the system compares the device's engine hours to a predetermined maintenance interval.

When the device's engine hours meet or exceed the predetermined maintenance interval, the system alerts the monitoring site. In another embodiment, when a base station establishes the monitoring area, it catalogues and transmits the description of the monitoring area to the device. An entry message is transmitted when the device crosses into the monitoring area. A departure message is transmitted when the device crosses out of the monitoring area. The time and date may be included in the messages. The monitoring area may be displayed using accurate mapping software.

Figure 7:
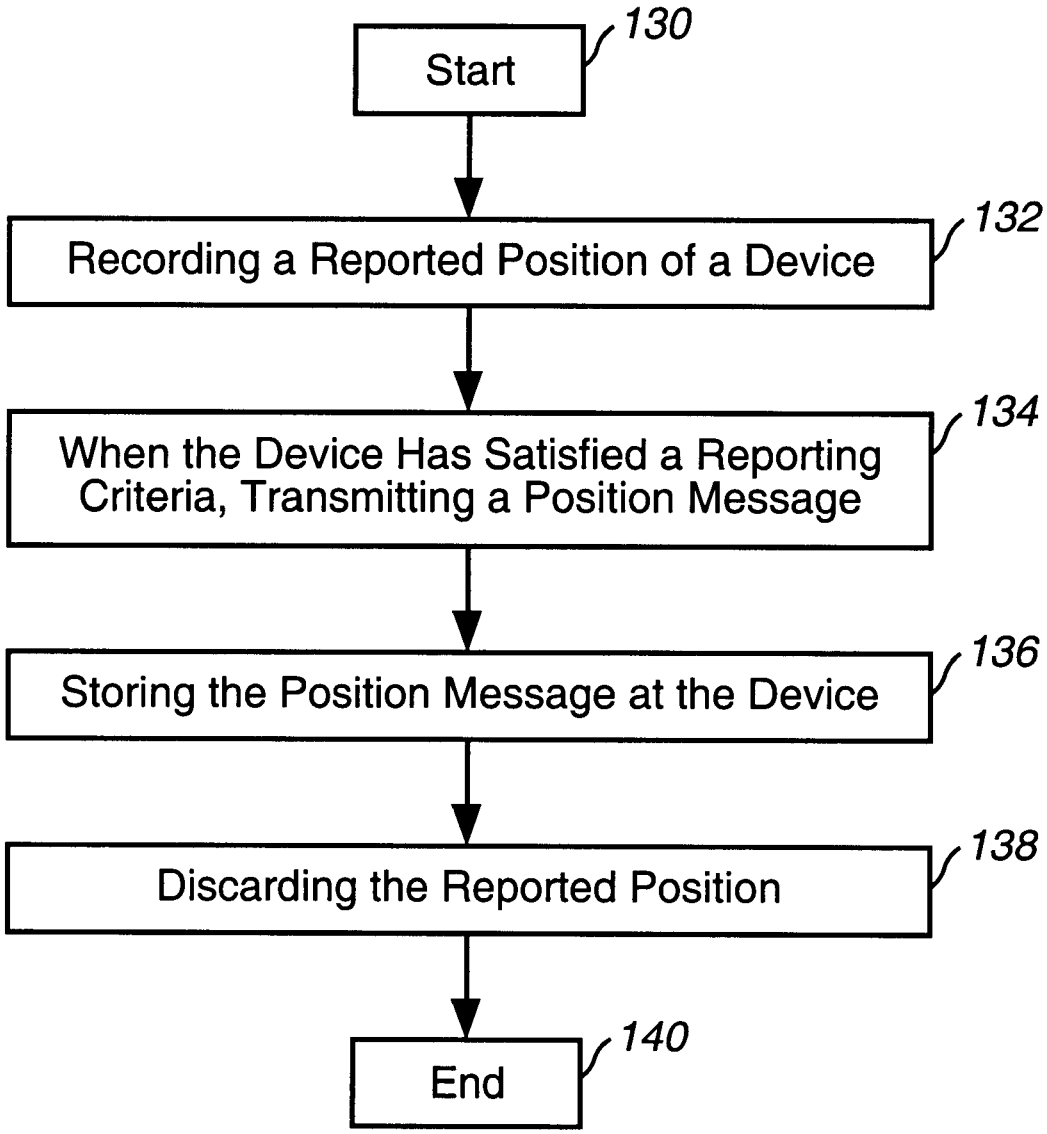
FIG. 7 is a flow chart of the steps used in a method of operating a moving fence system in accordance with one embodiment of the invention.

FIG. 7 is a flow chart of the steps used in a method of operating a moving fence system in accordance with one embodiment of the invention. The process starts, step 130, by recording the position of a device at step 132. The system transmits a position message when the device has satisfied a reporting criteria at step 134. The device stores the position message at step 136. The device discards the reported position at step 138, which ends the process at step 140. In one embodiment, the reporting criteria comprises the device breaking a moving fence and traveling a predetermined distance. In another embodiment, the reporting criteria includes the device breaking a predetermined number of moving fences. In another embodiment, the reporting criteria comprises the device breaking a predetermined number of moving fences and being within a moving fence for a predetermined amount of time. In another embodiment, the predetermined number of moving fences is one. In another embodiment, the reporting criteria comprises a predetermined period of time. In another embodiment, the step of transmitting a position message when the device has satisfied a reporting criteria 134 includes determining a received signal strength for a wireless communication system. When the received signal strength is less than a predetermined signal strength, the system switches to a second wireless communication system and sends the position message.

Thus, there has been described a method of operating a moving fence system which can monitor the position of assets, that can permit some movement of the asset without triggering a message, and that does not overwhelm the user with data and cost in tracking mode.

The methods described herein can be implemented as computer-readable instructions stored on a computer-readable storage medium that when executed by a computer will perform the methods described herein.

While the invention has been described in conjunction with specific embodiments thereof, it is evident that many alterations, modifications, and variations will be apparent to those skilled in the art in light of the foregoing description. Accordingly, it is intended to embrace all such alterations, modifications, and variations in the appended claims.

What is claimed is:

1. A method of operating a moving fence system, comprising the steps of:

(a) recording a reported position of a device;

(b) determining if a time is within an operation period or a nonoperation period;

(c) when the time is within an operation period, determining if the device has crossed a predetermined number of moving fences;

(d) determining if the device has been within a moving fence for a predetermined amount of time;

(e) when the device has moved the predetermined number of moving fences and has been within the moving fence for the predetermined amount of time, the device transmitting a position message.

2. The method of claim 1, further including the steps of:

(f) determining if the device has crossed predetermined number of moving fences;

(g) determining if the device has been within the moving fence for a predetermined amount of time;

(h) when the device has crossed the predetermined number of moving fences and has been within the moving fence for the predetermined amount of time, transmitting the position message.

3. The method of claim 2, further including the steps of:

(i) retaining the reported position in a memory until the position message is transmitted.

4. The method of claim 2, further including the steps of:

(h) cataloging a plurality of devices within the defined area.

5. The method of claim 1, wherein step (a) includes the steps of:

(a1) establishing the operation period and a nonoperation period;

(a2) establishing the predetermined number of moving fences and the predetermined amount of time for the operation period;

(a3) establishing a nonoperation predetermined number of moving fences and a nonoperation predetermined amount of time;

(a4) when the time is within the operation period, using the operation predetermined number of moving fences and the operation amount of time;

(a5) when the time is within the nonoperation period, using the nonoperation predetermined number of moving fences and the nonoperation predetermined amount of time.

6. The method of claim 1, wherein step (c) includes the steps of:

(c1) when the device crosses a previous moving fence, creating the moving fence;

(c2) when the device crosses the new moving fence, creating a subsequent moving fence;

(c3) determining a new position;

(c4) establishing the new moving fence boundary.

7. The method of claim 1, wherein step (e) includes the step of:

(e1) when the device has moved the predetermined number of moving fences and has not been within the moving fence for the predetermined amount of time, the position message is not transmitted.

8. The method of claim 1, further including the steps of:

(e1) when a predetermined amount of time has elapsed, transmitting the position message.

9. The method of claim 1, further including the steps of:

(e1) when the device has moved a predetermined number of moving fences, transmitting the position message.

10. The method of claim 1, wherein step (e) includes the step of:

(e1) when the device has not moved the predetermined number of moving fences and has been within the moving fence for the predetermined amount of time, the position message is not transmitted.

11. The method of claim 1, wherein step (b) includes the step of:

(b1) crossing a previous moving fence.

12. The method of claim 1, further including the steps of:

(f) receiving the position message at a monitoring site;

(g) determining if the device is within a defined area.

13. The method of claim 1, wherein the position message further comprises a time, a location, and an equipment identification information.

14. A method of operating a site fence system, comprising the steps of:

(a) defining a monitoring area;

(b) determining when a device enters and departs the monitoring area;

(c) determining if the device is within the monitoring area; and (d) when the device is within the monitoring area, adding the device to a catalog list.

15. The method of claim 14, further including the step of:

(e) receiving a position message, including a device's engine hours.

16. The method of claim 15, further including the steps of:

(f) comparing the device's engine hours to a predetermined maintenance interval; and (g) when the device's engine hours meets or exceeds the predetermined maintenance interval, alerting the monitoring site.

17. The method of claim 14, further including the step of:

(e) when a device crosses a site fence, transmitting a position message.

18. The method of claim 14, wherein step (a) includes the step of:

(a1) when a base station establishes the monitoring area, cataloguing and transmitting the description of the monitoring area to the device.

19. The method of claim 14, wherein step (b) includes the step of:

(b1) when the device crosses into the monitoring area, transmitting an entry message.

20. The method of claim 14, wherein step (b) includes the step of:

(b1) when the device crosses the monitoring area, transmitting a date and time.

21. The method of claim 14, wherein step (b) includes the step of:

(b1) when the device crosses out of the monitoring area, transmitting a departure message.

22. A method of operating a moving fence system, comprising the steps of:

(a) recording a reported position of a device;

(b) when the device has satisfied a reporting criteria, transmitting a position message;

(c) storing the position message at the device;

(d) discarding the reported position.

23. The method of claim 22, wherein the reporting criteria comprises the device crossing a moving fence and traveling a predetermined distance.

24. The method of claim 22, wherein the reporting criteria includes the device crossing a predetermined number of moving fences.

25. The method of claim 24 wherein the predetermined number of moving fences is a single moving fence.

26. The method of claim 22, wherein the reporting criteria comprises the device crossing a predetermined number of moving fences and being within a moving fence for a predetermined amount of time.

27. The method of claim 22, wherein the reporting criteria comprises a predetermined period of time.

28. The method of claim 22, wherein step (b) further includes the steps of:

(b1) determining a received signal strength for a wireless communication system;

(b2) when the received signal strength is less than a predetermined signal strength, switching to a second wireless communication system and sending the position message.

* * * * *